US005293450A

United States Patent [19]

Kane et al.

[11] Patent Number: 5,293,450

[45] Date of Patent: Mar. 8, 1994

[54] VOICE SIGNAL CODING SYSTEM

[75] Inventors: Joji Kane, Nara; Akira Nohara, Nishinomiya, both of Japan

[73] Assignee: Matsushita Electric Industrial Co., Ltd., Osaka, Japan

[21] Appl. No.: 706,575

[22] Filed: May 28, 1991

[30] Foreign Application Priority Data

May 28, 1990 [JP] Japan ..... 2-138065
May 28, 1990 [JP] Japan ..... 2-138066

[51] Int. Cl.[5] ..... G10L 3/02
[52] U.S. Cl. ..... 395/2.35; 395/2.42
[58] Field of Search ..... 395/2; 381/46, 47, 71, 381/94

[56] References Cited

U.S. PATENT DOCUMENTS

| | | | |
|---|---|---|---|
| 4,053,712 | 10/1977 | Reindl | 395/2 |
| 4,630,304 | 12/1986 | Borth et al. | 381/47 |
| 4,696,039 | 9/1987 | Doddington | 381/46 |
| 4,696,040 | 9/1987 | Doddington et al. | 395/2 |
| 4,918,734 | 4/1990 | Muramatsu et al. | 381/46 |
| 4,920,568 | 4/1990 | Kamiya et al. | 381/46 |

FOREIGN PATENT DOCUMENTS

WO87/00366 1/1987 PCT Int'l Appl. .
WO87/04294 7/1987 PCT Int'l Appl. .

OTHER PUBLICATIONS

McAulay, "Optimum Speech Classification and Its Application to Adaptive Noise Cancellation," IEEE ICASSP, Hartford, Conn., May 1977, pp. 425-427.

Boll, "Suppression of Acoustic Noise in Speech Using Spectral Subtraction", IEEE Trans on ASSP, vol. 27, No. 2, Apr. 1979, pp. 113-120.

Conway et al., "Adaptive Processing with Feature Extraction to Enhance the Intelligibility of noise-Corrupted Speech," International Conf. on Industrial Electronics, Control, and Instrumentation, Nov. 1987, pp. 1-6.

"Cepstrum Pitch Determination", A. Michael Noll, The Journal of the Acoustical Society of America, pp. 293-309.

"Quality Improvement of Synthesized Speech in Noisy Speech Analysis-Synthesis Processing", Hiromi Nagabuchi et al., 433 Electronics & Communications in Japan vol. 64-A, No. 9, 1981.

*Primary Examiner*—David D. Knepper
*Attorney, Agent, or Firm*—Wenderoth, Lind & Ponack

[57] ABSTRACT

A voice signal coding system includes a voice signal detector for receiving a mixed signal of an intermittent voice signal and background noise signal and for detecting the presence and absence of the voice signal contained in the mixed signal. A voice signal period detector is provided for detecting a voice signal period in which the voice signal is present. A coding period control circuit is coupled to the voice signal period detector for producing a coding period control signal during the voice signal period. A coding circuit receives and encodes the mixed signal in response to the coding period control signal. Thus, the mixed signal is coded in the coding circuit only during the voice signal periods.

4 Claims, 10 Drawing Sheets

VOICE SIGNAL CODING SYSTEM

BACKGROUND OF THE INVENTION

1. Field of the Invention

The present invention relates to a voice signal coding system adapted to encode noise-mixed voice signals.

2. Description of the Related Art

For transmitting voice signals to remote places, the voice signals are coded. According to the conventional coding method, the voice signals are coded together with background noise signals.

However, in such a coding method, since the data which is really necessary is the voice data, the coding of the background noise signal is wasteful.

SUMMARY OF THE INVENTION

Accordingly, an essential object of the present invention is to provide an object signal coding system which can solve the foregoing problem involved in conventional systems and is adapted to code only the object signals (i.e. the desired signals such as voice signals). The noise signals may be coded separately, if necessary.

In accomplishing these and other objects, an object signal coding system according to the present invention, comprises: an object signal detection means for receiving a mixed signal of an object signal and a background noise signal and for detecting the presence and absence of said object signal contained in said mixed signal; an object signal period detecting means for detecting an object signal period in which said object signal is present; a coding period control means for producing a coding period control signal during the object signal period; and a coding means for encoding said mixed signal in response to said coding period control signal, whereby only the object signals are coded in said coding means.

BRIEF DESCRIPTION OF THE DRAWINGS

These and other objects and features for the present invention will become apparent from the following description taken in conjunction with the preferred embodiment thereof with reference to the accompanying drawings, in which.

DETAILED DESCRIPTION OF THE INVENTION

Figure 1:
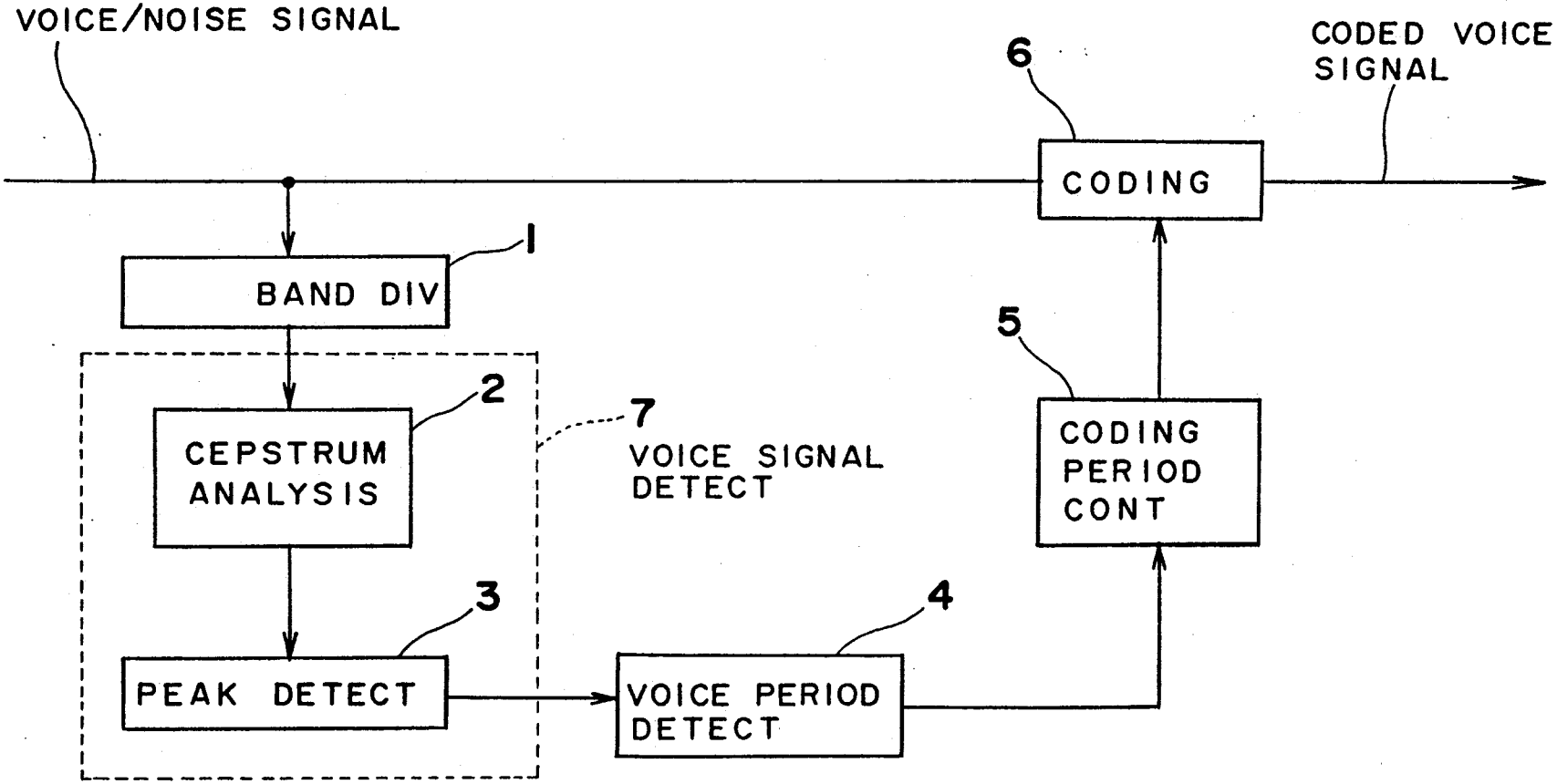
FIG. 1 is a block diagram of a voice signal coding system according to a first embodiment of the present invention.

Before the description of the present invention proceeds, it is to be noted that like parts are designated by like reference numerals throughout the accompanying drawings.

Referring to FIG. 1, a block diagram of a voice signal coding system according to a first embodiment of the present invention is shown.

In FIG. 1, a band dividing circuit 1 is provided for A/D conversion and for dividing the A/D converted input voice signal accompanying noise signal (noise mixed voice input signal) into a plurality (m) of frequency ranges by way of Fourier transformation at a predetermined sampling cycle. The divided signals are transmitted through m-channel parallel lines. The noise signal is present continuously as in the white noise signal, and the voice signal appears intermittently. Instead of the voice signal, any other data signal may be used.

Figure 4A:
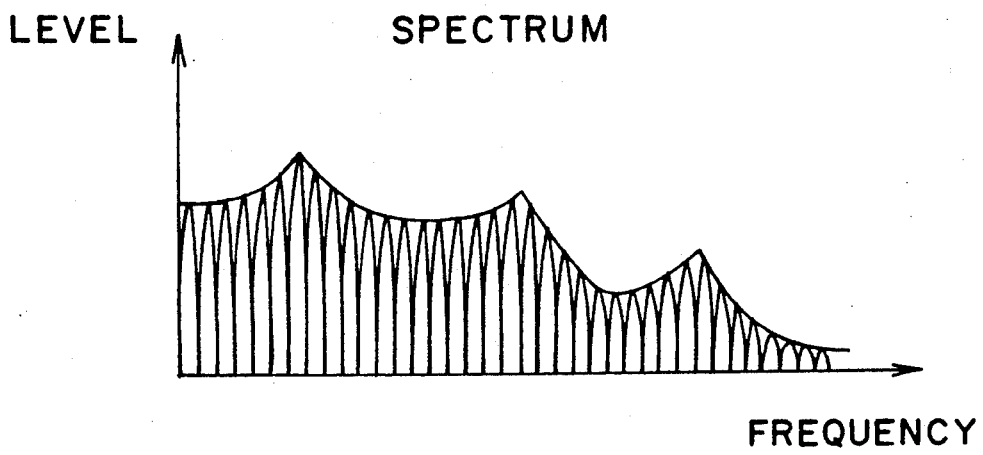
FIGS. 4*a* and 4*b* are graphs for explaining the cepstrum analysis used in the present invention.
Figure 4B:
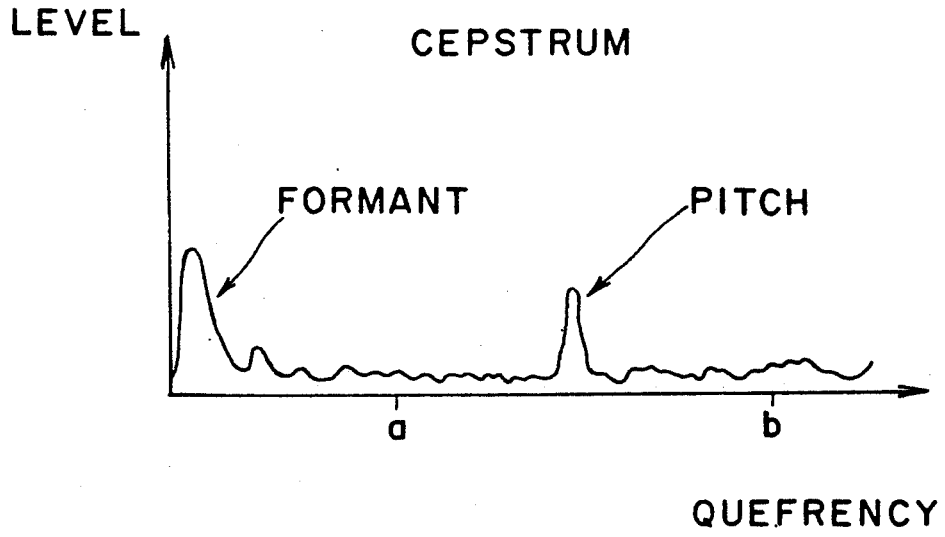

A voice signal detection circuit 7 receives the noise mixed voice input signal and detects the voice signal portion within the background noise signal and produces a signal indicative of an absence/presence of the voice signal. For example, as shown in FIG. 1, voice signal detection circuit 7 includes a cepstrum analyzing circuit 2 which detects portions wherein the voice signal is present employing cepstrum analysis, and a peak detection circuit 3 for detecting the peak of the cepstrum obtained by cepstrum analysis circuit 2. FIGS. 4*a* and 4*b* show spectrum analysis and cepstrum analysis to obtain the peak (i.e., pitch).

In the above arrangement, it is also possible to provide an average calculation circuit (not shown) to calculate the average of the cepstrum obtained by the cepstrum analysis circuit 2, and a voice discrimination circuit (not shown) to discriminate voice portions using the peak of the cepstrum fed by the peak detection circuit 3 and the average value of the cepstrum fed by the average calculation circuit. This arrangement allows discrimination between vowels and consonants, making it possible to accurately discriminate the voice portions. More specifically, when there is a signal input from the peak detection circuit 3 indicating that a peak has been detected, a vowel portion of the voice signal is detected. For discrimination of consonants, on the other hand, when a cepstrum average value fed from the average calculation circuit is greater than a predetermined specified value, or when the increment of the cepstrum average (differential coefficient) is greater than a predetermined specified value, that a consonant portion of the voice signal is detected. Then the resulting output is either a vowel/consonant representing signal, or one that represents a voice interval including vowels and consonants. The voice detection circuit 7 is not limited to the one in this embodiment, and may be substituted by another method.

A voice period detector 4 serves to discriminate a voice period, for example, the start time and end time of a voice signal in accordance with a voice signal portion detected by the voice detection circuit 7.

A coding period control circuit 5 serves to produce a control signal for encoding during a voice period.

A coding circuit 6 encodes a voice signal in accordance with the control signal from the coding period control circuit 5. The coding circuit 6 is selected depending on the circuit that is connected in the following stage. For example, the coding circuit may be of a type that includes the method of linear conversion using an analog-to-digital converter or the μ-law coding that involves logarithmic compression.

The operation of the above described embodiment of the present invention is explained in connection with FIG. 3.

Figure 3:
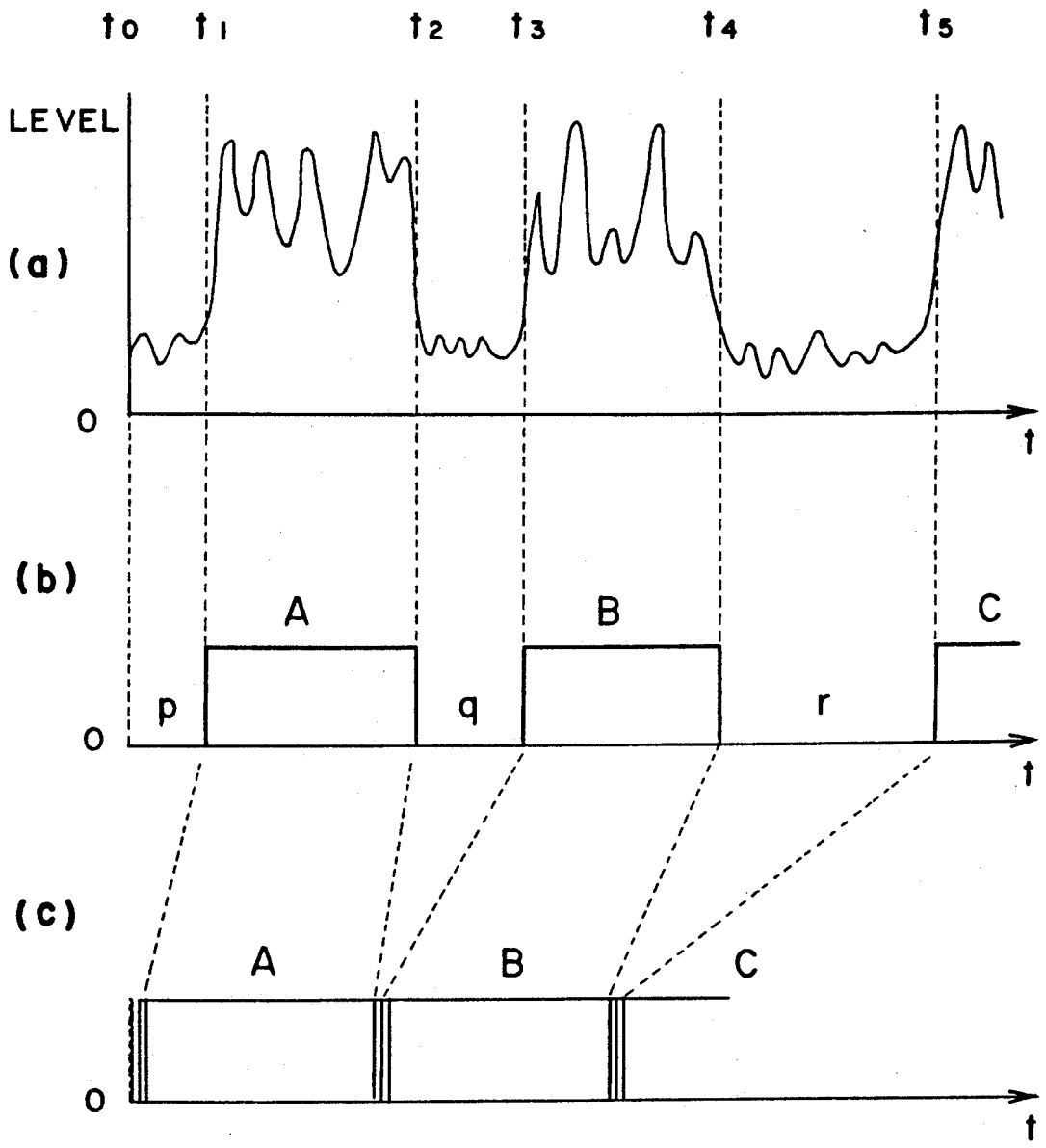
FIG. 3 is a graph showing an operation of the present invention.

In FIG. 3, row (a), a noise-mixed voice signal is shown, in which the high-level portions (such as $t_1$-$t_2$, $t_3$-$t_4$) are the voice portions, and the low-level portions (such as $t_0$-$t_1$, $t_2$-$t_3$, $t_4$-$t_5$) are the noise portions.

The band dividing circuit 1 receives the noise-mixed voice signal (row (a)). The cepstrum analysis circuit 2 effects cepstrum analysis with respect to the signal from the band dividing circuit 1. The peak detection circuit 3 detects the peak of the cepstrum analysis result. The voice period detector 4 discriminates a voice period in accordance with the result of peak detection. In FIG. 3, row (b), blocks A, B and C represent the voice signal periods during which the coding is executed, and the intervening periods p, q and r are skip periods during which the coding is not executed. Then the coding period control circuit 5 produces a control signal in accordance with the voice signal period information.

The coding circuit 6 encodes only the voice signal periods A, B and C in the example shown in FIG. 3 in accordance with the control signal. As a result, the noise signal periods are compressed, as shown in FIG. 3, row (c), in which the coded voice signals, each accompanying start and end codes, are connected without any interval.

Figure 2:
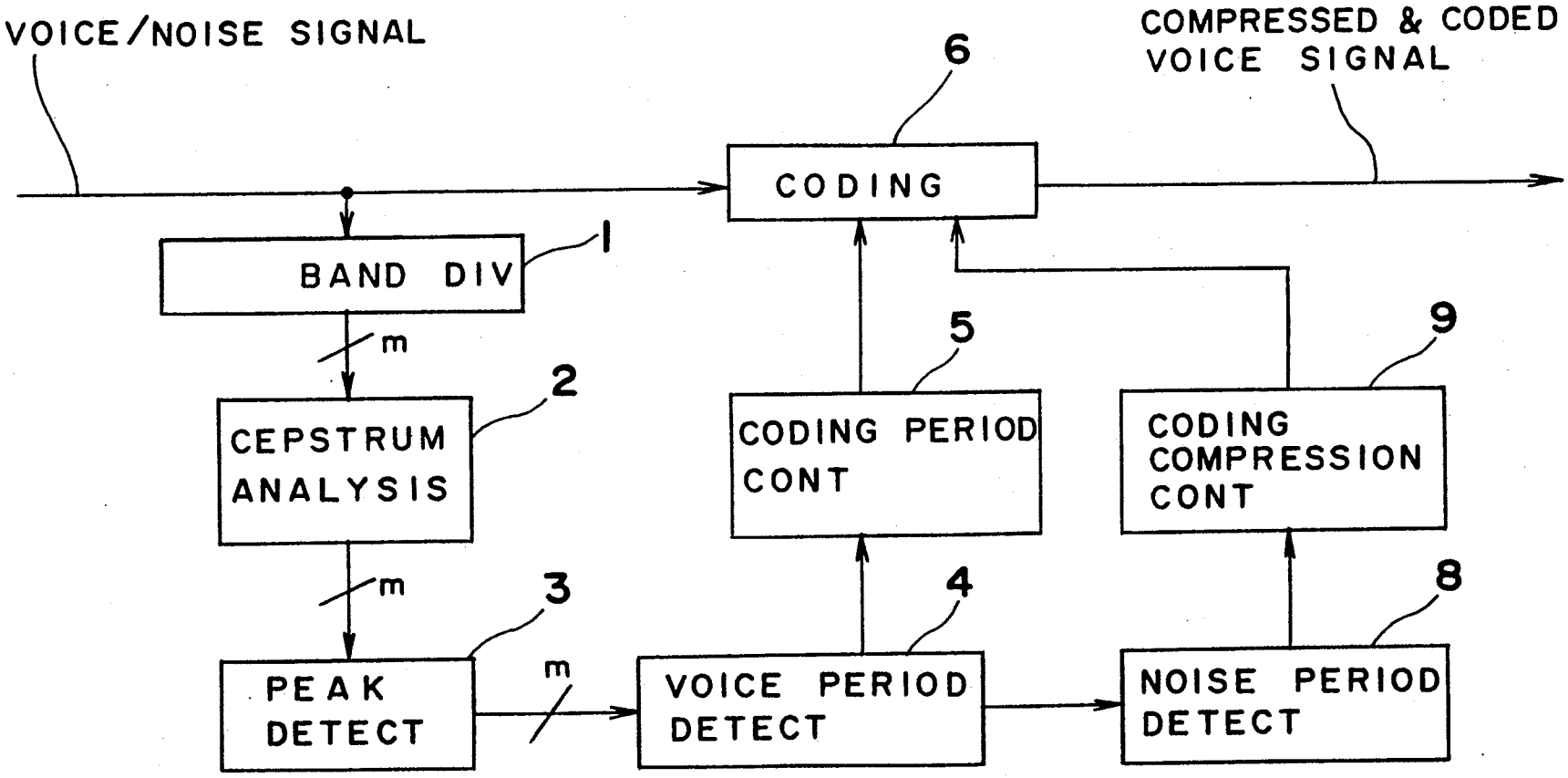
FIG. 2 is a block diagram of a voice signal coding system according to a second embodiment of the present invention.

Referring to FIG. 2, a second embodiment of the present invention is shown. When compared with the first embodiment shown in FIG. 1, the second embodiment is further provided with a noise period detector 8 and a coding-compression control circuit 9.

The noise period detector 8 discriminates a noise period in accordance with voice period information discriminated by the voice period detector 4. The coding-compression control circuit 9 calculates the length of a noise period based on the discriminated noise period information and further encodes the data indicating the noise signal period. The noise period length may be calculated in the noise period detector 8, while the coding of the data indicating the noise period may be carried out in the coding-compression control circuit 9.

The coding circuit 6 according to the second embodiment encodes the voice signal depending on a control signal from the coding period control circuit 5 and, inserts the coded noise period data from the coding-compression control circuit 9. The coded noise period data may be inserted at any possible portion.

Figure 5:
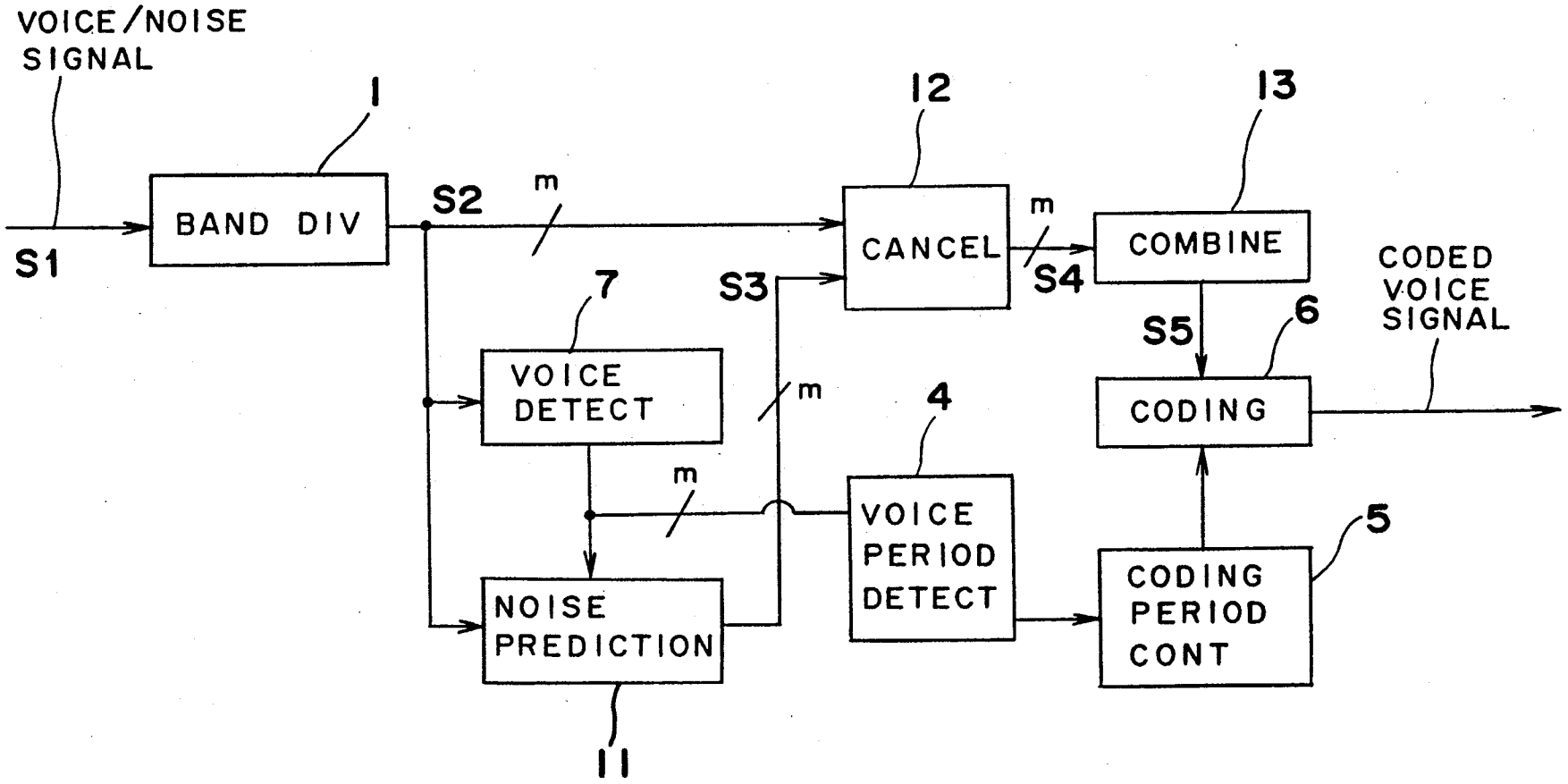
FIG. 5 is a block diagram showing a third embodiment of the voice-noise separator of the invention.

Referring to FIG. 5, a block diagram of a third embodiment of the present invention is shown.

In the first embodiment, the voice/noise signal is coded by the coding circuit 6 as it is, but in the present third embodiment, the voice/noise signal that has passed through the band divider circuit 1, at which the signal is divided into m channels, and also through the combining circuit 5, at which the divided signals are combined or synthesized, is coded. Furthermore, in the third embodiment, noise prediction circuit 11 and cancellation circuit 12 are provided so that the noise signal existing in the voice/noise signal is eliminated. The detail of the noise signal prediction is disclosed in our U.S. application Ser. No. 07/706,572, entitled "NOISE SIGNAL PREDICTION SYSTEM", filed on the same day as the present application.

A noise prediction circuit 11 includes a noise level detector for detecting the level of the actual noise signal at every sampling cycle but only during the absence of the voice signal, a storing circuit for storing noise levels obtained during predetermined number of sampling cycles before the present sampling cycle, and a noise level predictor for predicting the noise level of the next sampling cycle based on the stored noise signals. The prediction of the noise signal level of the next sampling cycle is carried out by evaluating the stored noise signals, for example by taking an average of the stored noise signals. In this case, the predictor is an averaging circuit.

Figure 9:
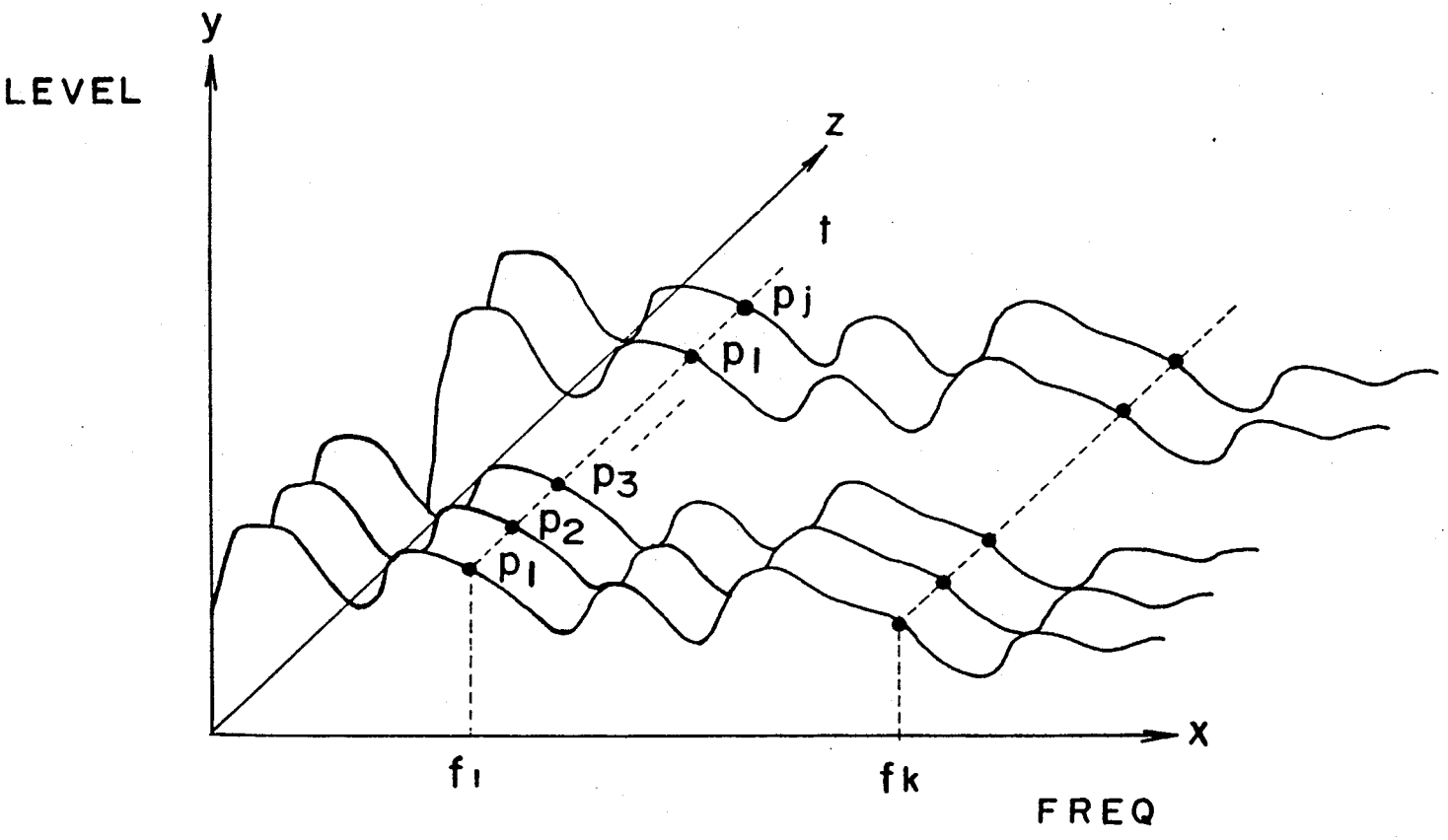
FIG. 9 is a graph for explaining a noise prediction method used in the present invention.
Figures 10A, 10B, 10C, 10D, 10E:
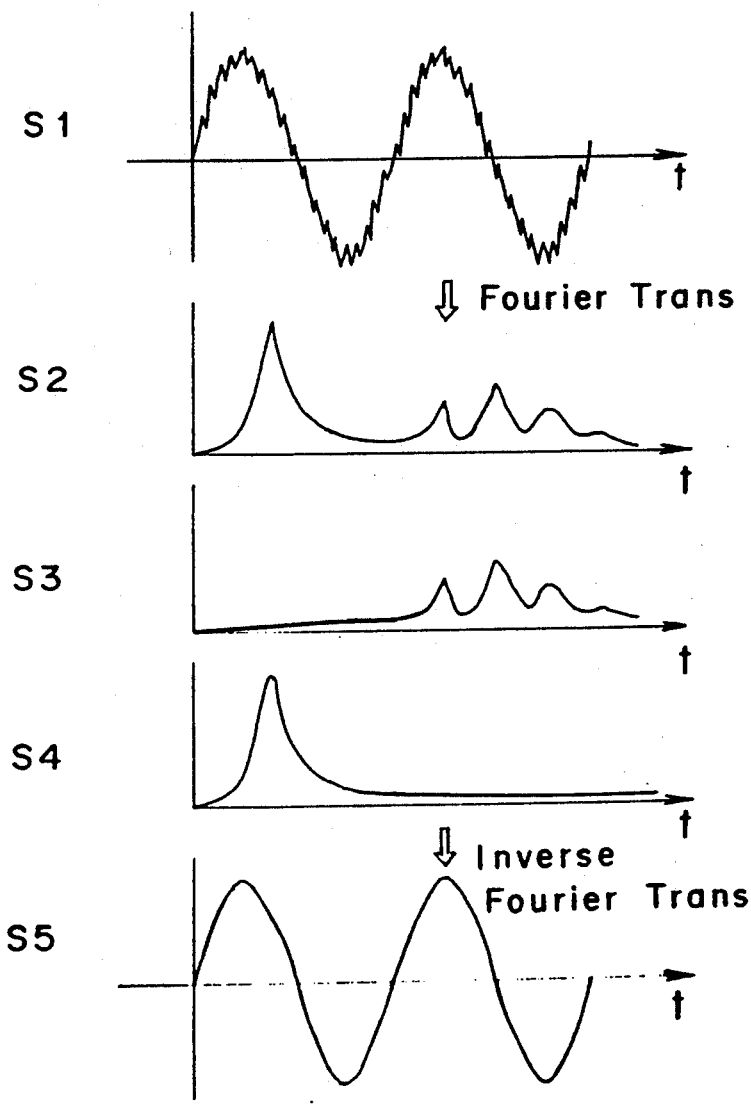
FIGS. 10*a*, 10*b*, 10*c*, 10*d* and 10*e* are graphs for explaining a canceling method used in the present invention.

The noise prediction circuit 11 receives the noise mixed voice input signal that has been transformed to Fourier series, as shown in FIG. 9, in which the X-axis represents frequency, the Y-axis represents noise level and the Z-axis represents time. Noise signal data pl-pi during the predetermined past time is collected in the noise prediction circuit 11, and is evaluated, such as taking an average of pl-pi, to predict a noise signal data pj in the next sampling cycle. Preferably, such a noise signal prediction is carried out for each of the m-channels of the divided bands.

Thus, in the noise prediction circuit 11, during absence an of the voice signal as detected by the signal detector 7, the noise signal level of the next sampling cycle is predicted using the stored noise signals. The predicted noise signal level is sent to a cancellation circuit 12. After that, the predicted noise signal is replaced with the actually detected noise signal and is stored in the storing circuit. Thus, during the absence of the voice signal, the storing circuit stores actually detected noise signal at every sampling cycle, and the prediction is effected in the predictor accordance the actually detected noise signal.

On the other hand, during a presence of the voice signal as detected by signal detector 7, the noise signal level of the next sampling cycle is predicted in the same manner as described above, and is sent to the cancellation circuit 12. After that, since there is no actually detected noise signal at this moment, the predicted noise signal is stored in the storing circuit together with other noise signals obtained previously. Thus, during the presence of the voice signal, the actual noise signals of the past data as stored in the storing circuit are sequentially replaced by the predicted noise signals.

The cancellation circuit 12 is provided to cancel the noise signal in the voice signal by subtracting the predicted noise signal from the Fourier transformed noise mixed voice input signal, and is formed, for example, by a subtractor.

A combining circuit 13 is provided after the cancellation circuit 12 for combining or synthesizing the m-channel signals to produce a voice signal with the noise signals being canceled not only during the voice signal absent periods, but also during the periods at which the voice signal is present. The combining circuit 13 is formed, for example, by an inverse Fourier transformation circuit and a D/A converter.

In FIG. 5, signal sl is a noise mixed voice input signal (FIG. 9*a*) and signal s2 is a signal obtained by Fourier transforming of the input signal sl (FIG. 9*b*). Signal s3 is a predicted noise signal (FIG. 9*c*) and signal s4 is a signal obtained by canceling the noise signal (FIG. 9*d*).

It is to be noted that in FIG. 5, only one signal s2 is shown for the sake of brevity, but actually there are m signals s2 for m-channels, respectively. Similarly, there are m signals s3 and m signals s4.

Signal s5 is a signal obtained by inverse Fourier transforming the noise canceled signal (FIG. 9*e*).

The operation of the third embodiment of the present invention shown in FIG. 5 is described below.

A noise-mixed voice signal is divided into a plurality of channels by the band dividing circuit 1, and the divided signals are applied to voice detection circuit 7 and also to the noise prediction circuit 11. The voice detection circuit 7 performs cepstrum analysis, as described above, and further detects the peak in accordance with the cepstrum analysis result.

The noise prediction circuit 11 predicts the noise signal level of voice portions in each channel. The cancellation circuit 12 eliminates the noise signal in each channel using the predicted noise.

The combining circuit 13 combines the noiseless voice signal in the plurality of channels.

The coding circuit 6 encodes the combined signal only during the presence of the voice signal in accordance with a coding period control signal.

Figure 6:
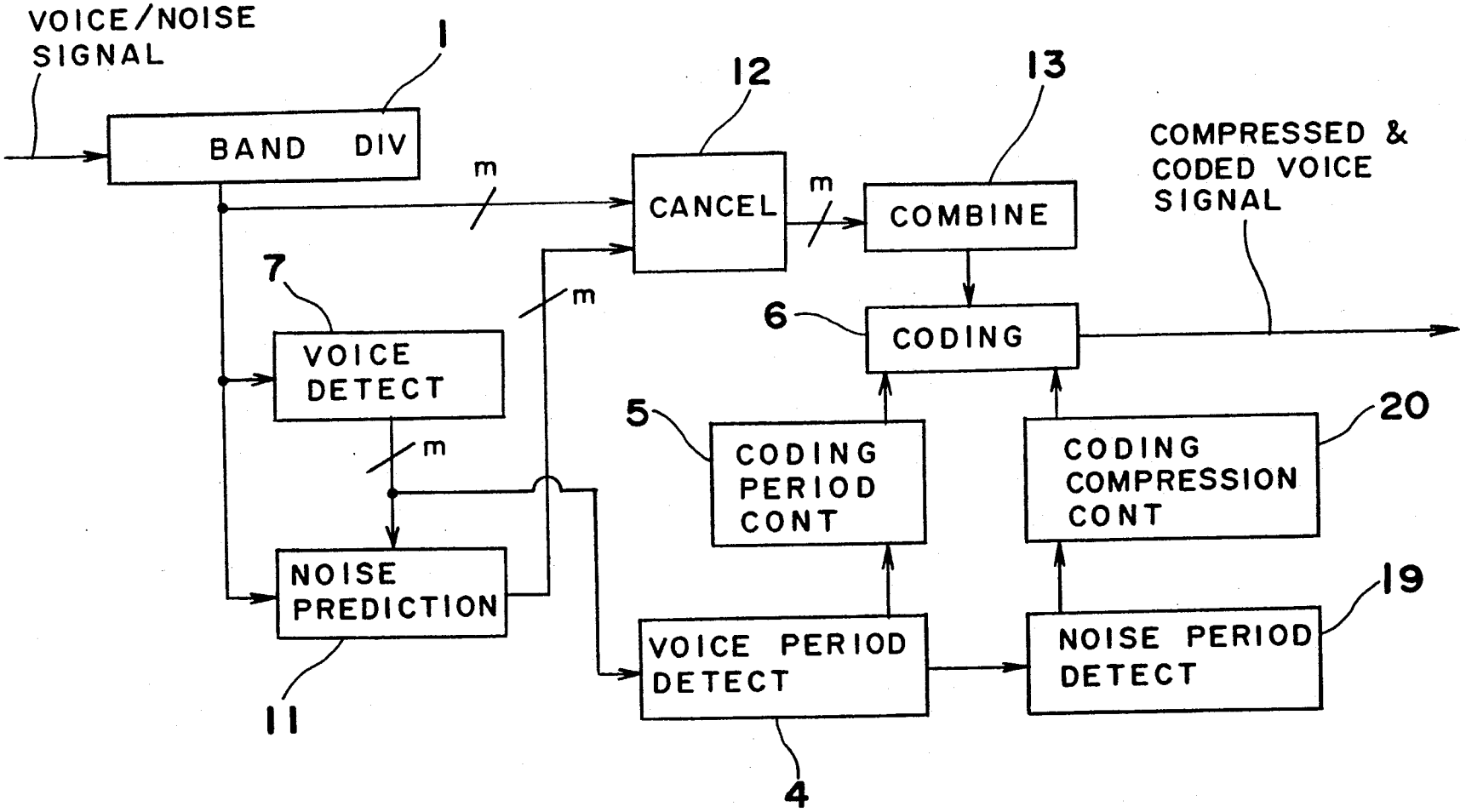
FIG. 6 is a block diagram of a voice signal coding system according to a fourth embodiment of the present invention.

Referring to FIG. 6, a fourth embodiment of the present invention is shown. When compared with the third embodiment shown in FIG. 5, there are additionally provided a noise period detector 19 and coding-compression control circuit 20.

The noise period detector 19 detects a noise period, or an intervening period between the voice signals, based on the voice period information detected by the voice period detector 4. The coding-compression control circuit 20 calculates the length of the noise period from the detected noise period information and encodes the data representing the length of the noise period. The noise period length may be calculated in the noise period detector 19, while the coding of the data indicating the noise period may be carried out in the coding-compression control circuit 20.

The coding circuit 6 according to the fourth embodiment encodes the voice signal in accordance with a control signal from the coding period control circuit 5 and, inserts the coded noise period data from the coding-compression control circuit 20. The coded noise period data may be inserted at any possible portion.

Figure 7:
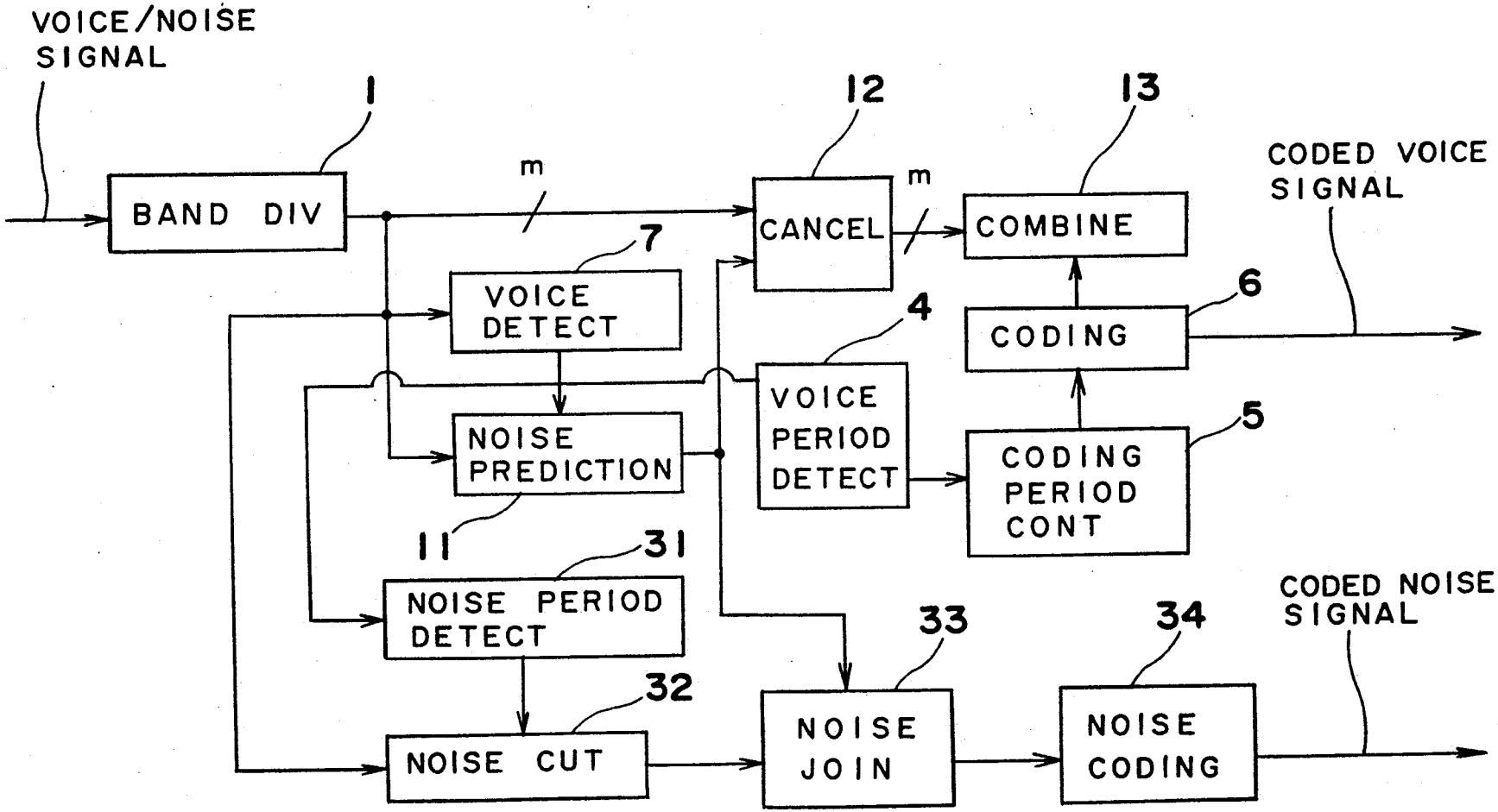
FIG. 7 is a block diagram of a voice signal coding system according to a fifth embodiment of the present invention.

FIG. 7 shows a fifth embodiment of the invention. When compared with the third embodiment in FIG. 5, the fifth embodiment further has circuits 31, 32, 33, and 34, whereby the noise signals are coded separately from the voice signal.

The noise period detector 31 detects a noise period based on the voice information detected by the voice detection circuit 7.

The noise cutout circuit 32 cuts the noise signal from the above-mentioned divided signal in accordance with the resulting noise period information to extract only the noise signal.

The noise signal joining circuit 33 performs a switching operation that connects the extracted noise signal and the predicted noise signal predicted by the noise prediction circuit 11 to produce a continuing noise signal.

The noise signal coding 34 is circuit for encoding the continuing noise signal. The present embodiment allows the coding of a continuing noise signal separately from the coded voice signals. For instance, if the voice is a singing voice and the noise signal is orchestral music played as background, then the singing voice and the background orchestral music can be separated from each other.

Figure 8:
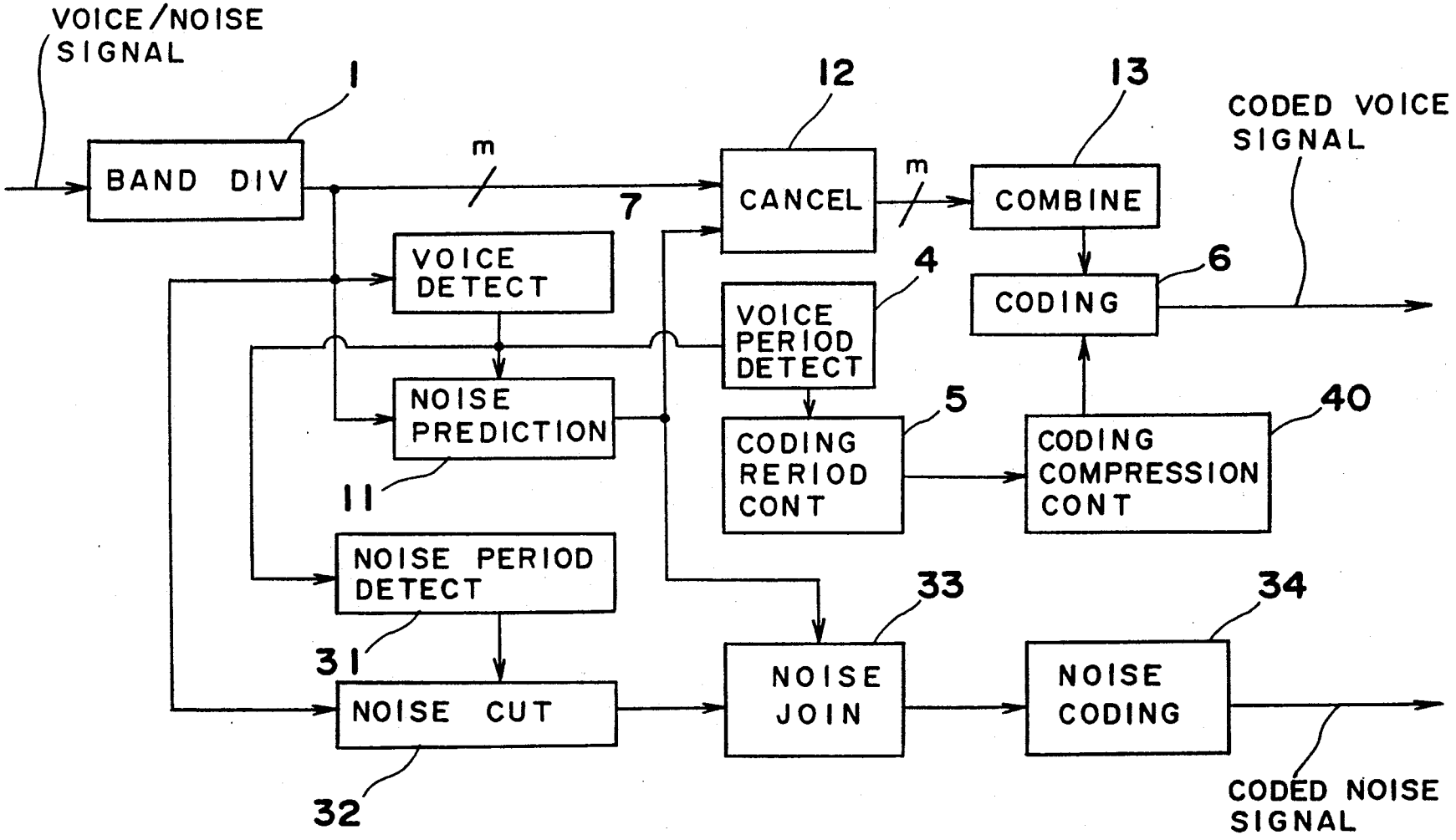
FIG. 8 is a block diagram of a voice signal coding system according to a sixth embodiment of the present invention.

Referring to FIG. 8, a sixth embodiment of the present invention is shown. When compared with the fifth embodiment shown in FIG. 7, a coding-compression control circuit 40 is further provided after the coding period control circuit 5 for receiving a coding control signal of the voice and producing noise-compression control information. This enables the coding circuit 6 to add the length of the original noise period as information when it compresses the noise periods.

In any of the foregoing embodiments, it is possible to assemble the system by way of hardware or by way of software employing a computer to do the function of various circuits.

As apparent from the above description, since the voice coding system according to the present invention is adapted to encode only voice portions out of a noise-mixed voice signal and, in turn, compresses noise portions thereof, it is possible to obviate the wasteful processing of encoding noise signals. Thus, the data transmission rate can be improved.

Furthermore, the voice coding system of the present invention can cancel noise signals effectively by predicting the noise signal in the voice signal portions.

Still further, according to the present invention it is possible to obtain noise signals in coded form separately from the coded voice signals.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A wanted signal coding system for coding an intermittent wanted signal contained in a mixed signal having the intermittent wanted signal mixed with a background noise signal, said system comprising:

coding means, receiving said mixed signal, for coding said mixed signal when a control signal is applied thereto to generate a coded output signal and for not coding said mixed signal when said control signal is not applied thereto;

wanted signal detecting means, receiving said mixed signal, for detecting periods during which said wanted signal is present in said mixed signal;

control signal generating means, coupled to said wanted signal detecting means, for generating said control signal applied to said coding means during periods detected by said wanted signal detecting means during which said wanted signal is present in said mixed signal;

noise prediction means for predicting a noise signal contained in said mixed signal during periods in which said wanted signal is present in said mixed signal based on a previous noise signal;

cancellation means for subtracting the predicted noise signal from the mixed signal to cancel the predicted noise signal from the mixed signal prior to coding of the mixed signal by said coding means;

noise signal detecting means, coupled to said wanted signal detecting means, for detecting noise signal periods during which the wanted signal is not present in said mixed signal;

coding-compression control means, coupled to said noise signal detecting means, for determining a duration of each noise signal period detected by said noise signal detecting means and for generating coded noise period data denoting the duration of each detected noise signal period, wherein said coded noise period data is inserted in said coded output signal generated by said coding means;

noise extraction means for extracting the noise signal from said mixed signal during said noise signal periods;

noise signal joining means for joining the extracted noise signal and the predicted noise signal to generate a continuous noise signal; and, noise signal coding means for coding said continuous noise signal.

2. A wanted signal coding system as claimed in claim 1, wherein said wanted signal is an analog signal and wherein said coding means and said noise signal coding means effect analog-to-digital conversion according to a predetermined coding scheme.

3. A wanted signal coding system as claimed in claim 2, wherein said predetermined coding scheme is mu-law coding.

4. A wanted signal coding system as claimed in claim 3, wherein said wanted signal is a voice signal.

* * * * *